US008187065B1

(12) United States Patent
Poisson

(10) Patent No.: US 8,187,065 B1
(45) Date of Patent: May 29, 2012

(54) VIDEO CARD GAMING SYSTEM FOR SIMULATING A FOOTBALL GAME

(76) Inventor: Renald Poisson, Houston, TX (US)

( * ) Notice: Subject to any disclaimer, the term of this patent is extended or adjusted under 35 U.S.C. 154(b) by 426 days.

(21) Appl. No.: 12/427,036

(22) Filed: Apr. 21, 2009

Related U.S. Application Data

(60) Provisional application No. 61/046,845, filed on Apr. 22, 2008.

(51) Int. Cl.
*A63F 9/24* (2006.01)

(52) U.S. Cl. ..... 463/4

(58) Field of Classification Search ..... 463/4, 7, 463/43, 11; 273/298
See application file for complete search history.

(56) References Cited

U.S. PATENT DOCUMENTS 5,772,512 A 6/1998 Chichester
5,779,549 A 7/1998 Walker et al.
5,906,370 A 5/1999 Poisson
6,135,885 A * 10/2000 Lermusiaux ..... 463/20
6,758,754 B1 7/2004 Lavanchy et al.
2004/0066002 A1 * 4/2004 Spring ..... 273/298
2006/0252530 A1 11/2006 Oberberger et al.

* cited by examiner

*Primary Examiner* — Brook Kebede
(74) *Attorney, Agent, or Firm* — Busky Law Group, PC; Wendy Buskop

(57) ABSTRACT

A video card gaming system for simulating a football game comprising a processor. At least one input device, display device, monetary acceptance feature, and database are in communication with the processor. The database comprises an electronic deck of playing cards comprising offensive play cards and defensive play cards, and an electronic deck of special teams cards. Computer instructions in the database instruct the processor to permit input of primary and secondary bets, electronically deal cards from the electronic decks, designate offense and defense players, permit selection of cards by players, determine game outcomes based on the selected cards, and award winnings based on bets and game outcomes.

15 Claims, 2 Drawing Sheets

VIDEO CARD GAMING SYSTEM FOR SIMULATING A FOOTBALL GAME

CROSS REFERENCE TO RELATED APPLICATIONS

This application claims priority to U.S. Provisional Application Ser. No. 61/046,845 filed on Apr. 22, 2008, entitled: "Video Card Gaming System for Simulating a Football Game". This reference is hereby incorporated in its entirety herein.

FIELD

The present embodiments generally relate to video card gaming system for simulating a football game. The simulated football game closely follows how professional football games are played and includes a monetary acceptance feature for placing bets based on game outcomes relating to individual cards, short term game outcomes, and long-term game outcomes.

BACKGROUND

A need exists for a video card gaming system that simulates a game of football and closely follows the manner in which professional football games are played, enabling users to experience the enjoyment of a simulated football game combined with the ease and familiarity of a casino, arcade, or other facility-based video card machine.

A further need exists for a video card gaming system that provides a simulated game of football that is played using cards, thereby incorporating card game elements and strategies, such as bluffing, learning playing strategies, counting cards, and the confrontation and competitive aspects of popular card games.

A need also exists for a video card gaming system for providing a simulated game of football that allows users to place bets and receive winnings based on odds and game outcomes, in the style of popular slot and video card machines, and that combines single-play and long-term bets to retain player interest.

The present embodiments meet these needs.

BRIEF DESCRIPTION OF THE DRAWINGS

The detailed description will be better understood in conjunction with the accompanying drawings as follows.

Figure 1:
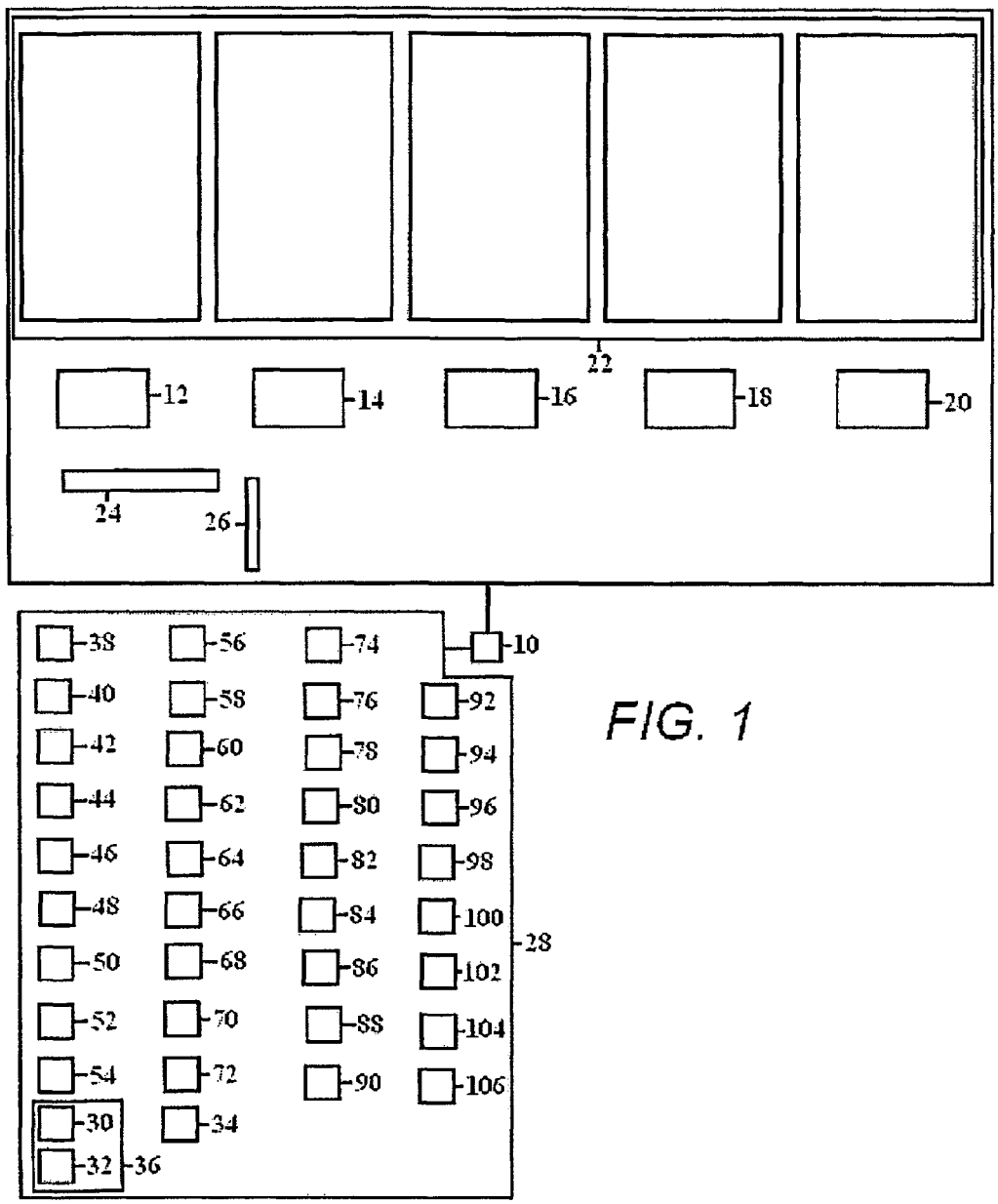
FIG. 1 depicts a schematic drawing of the components of an embodiment of the present system.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a video card gaming system for simulating a football game that combines gameplay and finesse elements found in popular card games with odds and gambling elements found in casinos, slot machines, arcade games and video card games.

The present system provides the benefit of enabling one or more users to participate in a simulated football game that closely follows the manner in which professional football games are played. Offensive cards representing nearly all types of plays used in professional football can be played, each offensive card indicating an outcome, such as a gain of yards, and/or special instructions. Defensive cards having corresponding types of plays indicated thereon can be used to counter offensive cards, negating a gain of yards, causing a loss of yards, and/or providing other special instructions.

Special teams cards can be dealt in certain circumstances, to simulate the results of special team plays, such as kickoffs, punts, punt returns, and field goal attempts.

The present system can enable users to enjoy a simulated game of football that can incorporate both card game and gambling elements, using a user-friendly, familiar interface, such as those found in video card machines, arcades, casinos, and other similar locations.

The present system is advantageously easy to utilize and can permit use of any type and any number of user-friendly input devices, such as buttons, keypads, levers, switches, a touch screen, or other similar input devices. Through use of computer instructions, the present system can automatically randomize and deal cards, and a player need only select visible cards depicted on a display device to cause the simulated football game to progress. The present system can automatically deal replacement cards, as necessary, and can further perform all necessary processes and calculations to determine a game outcome based on the selected cards. The present system can provide video and/or animated output representing the game outcome to retain user interest.

The present system can provide education relating to the sport of football to players and onlookers in a fun and entertaining manner, using the strategic and finesse-based elements of card gaming.

The present system can further provide the advantage of enabling placement of both short term and long term bets relating to game outcomes and play achievements. For example, a player can place numerous individual bets on each play as the game progresses, in the manner of a slot machine or video card machine, while placing one or more secondary, long term bets on the overall outcome of the simulated game of football, on a specific spread or total of points, on one or more specific accumulated game statistics, or on the occurrence of a specific game outcome or play achievement.

The long term bet feature of the present system can thereby provide the benefit of prolonged player entertainment and interest, allowing casinos, arcades, and other private owners of the present video card gaming system to receive increased revenue. In the above example, a player who has placed a long term bet relating to the outcome of the game or a specific point total would have an incentive to continue making individual plays, generating revenue, until determining whether the long term bet has been won or lost.

Additionally, the long term bet feature can enable players to strategically select plays and develop an individualized playing style suited for achieving a game outcome that could potentially win a long term bet, providing an added level of strategy and enjoyment not found in traditional video card games.

Even when no long term bet has been placed, a player can become invested in the overall outcome of the simulated game of football, and the related strategic and game-play elements.

The present system can include a processor, such as an Intel™ processor, an AMD™ processor, or another similar type of processor able to execute computer instructions.

At least one input device can be in communication with the processor. Input devices can include buttons, levers, switches, keypads, a touch screen, and other similar devices.

At least one display device can also be in communication with the processor. Display devices can include any type of monitor, screen, or similar type of device able to generate an image.

The present system can also include one or more monetary acceptance features, which can also be in communication with the processor.

Monetary acceptance features can include means for accepting credit cards and debit cards, such as card readers, means for accepting currency, such as bill and coin insertion slots, means for accepting facility-specific credits, such as readers for cards issued by casinos, or combinations thereof. It can also be contemplated that one or more input devices can also function as a monetary acceptance feature. For example, a keypad can be used to input a credit card or debit card number and other information necessary to process charges. A series of buttons or a touch screen can also be used to select numbers to input credit card or debit card information.

The present system can also include a database, which can be in communication with the processor.

The database can include an electronic deck of playing cards. The electronic deck of playing cards can include both offensive play cards and defensive play cards used to simulate plays by an offensive football team and defensive plays to counter the offensive plays.

Offensive play cards can include run cards, which display thereon a type of football running play and a result, which can include a gain of yards. In an embodiment, run cards can include pitch out, end run, off tackle, trap play, flanker reverse, line plunge, draw play, end sweep, end around, or double reverse. Run cards can also include special instructions in addition to, or in lieu of a gain or yards, such as a quarterback sneak card.

Offensive play cards can also include pass cards, which display thereon a type of football passing play and a result, which can include a gain of yards. In an embodiment, pass cards can include tight-end pass, sideline pass, split-end pass, short pass, down and out pass, long pass, down and in pass, halfback pass, flanker screen pass, or fullback screen pass.

Offensive play cards can further include penalty cards, which can display thereon a type of football penalty called against a defensive team. Each penalty card can include a penalty name and a result, such as a gain or loss of yards and/or special instructions. In an embodiment, penalty cards can include defense offside cards.

Offensive play cards can also include option plays, which can provide a choice between a listed run or pass play, with or without special instructions, such as an "option play end run or pass complete" card.

Defensive play cards can include run cards that display a type of running play corresponding to one or more types of running plays listed on offensive play cards, paired with a result or instructions, such as a loss of yards or an indication of no gain. For example, an offensive play card reading "end run, 10 yard gain" can be played. In response to the offensive play card, a defensive play card reading "end run, no gain" can be played, nullifying the 10 yard gain of the offensive play card and resulting in the accumulation of a down.

It can be contemplated that a football offense player can attempt to play offensive play cards for which a football defense player lacks a responsive card, while the football defense player attempts to strategically predict and/or coax certain offensive play cards to be played. For example, a football defense player can elect to avoid playing an "end run, no gain" card in response to an offensive play card reading "end run, 5 yard gain," with the intent that a football offense player may falsely conclude that the football defense player lacks any cards to counter an end run card. Then, if the football offense player plays a second end run offensive play card, such as a card reading, "end run, 15 yard gain," the football defense player can then play the "end run, no gain" card.

As play progresses, it can be contemplated that players can track past plays and count cards, facilitating the prediction of future plays and enabling strategic decisions based on card counts and statistical odds.

Defensive play cards can also include pass cards that display a type of passing play corresponding to one or more types of passing plays listed on offensive play cards, paired with a result or instructions, such as an indication of an incomplete pass and accumulation of a down.

Defensive play cards can further include special cards, such as an interception card, which indicates the interception of a specified type of pass paired with a result, such as a number of yards gained by the defensive team, and can include special instructions. Special cards can also include quarterback sack cards, which can include a result, such as a loss of yards, and/or special instructions. Special cards can also include option plays, which can include one or more types of play listed on an offensive play cards, paired with results and/or special instructions.

Special cards can also include a fumble card, which can include special instructions, and which can result in a turnover, causing the offensive team to be designated as the defensive team, and vice versa.

Defensive cards can additionally include penalty cards, which include a type of football penalty called against an offensive team, and a result, such as a loss of yards and/or special instructions. In an embodiment, penalty cards can include offensive holding and offense offside cards.

The database can also include an electronic deck of special teams cards, used to simulate special teams plays undertaken by both offensive and defensive football teams. It can be contemplated that cards from the electronic deck of special teams cards are dealt randomly when placed in play, rather than selected by players for use.

It can be contemplated that a football offense player can elect to have a special teams card electronically dealt in lieu of playing an offensive or defensive football card to simulate special plays, such as field goal attempts, points after touchdowns, punts, punt returns, and kickoff returns. Each special teams card can be contemplated to include a list of results, which can include a number of yards gained or lost, success or lack thereof of a field goal or point after touchdown, a fumble, a touchback, a blocked punt or field goal, or a touchdown. Each listed result can be associated with one item from a list of special teams plays, such as a field goal attempt, a point after touchdown attempt, a punt attempt, a punt return attempt, or a kick off return attempt.

The database can further include computer instructions for instructing the processor to permit input of a primary bet from the input device and the monetary acceptance feature. For example, a user can insert a credit card into a credit card reader, then use a keyboard or touch screen to enter and confirm a bet amount.

It can be contemplated that primary bets can relate to individual card selections or groups of card selections. For example, a primary bet of one dollar can be placed relating to the next card played, and if the next card results in a gain of twenty yards or more, winnings of two dollars can be awarded. If the next card results in a gain of fewer than twenty yards but more than zero yards, winnings of one dollar can be awarded. If the next card results in no gain of yards or a loss of yards, the primary bet can be lost.

A primary bet relating to a group of up to four plays, simulating a football possession, can also be placed. For example, a primary bet of two dollars can be placed relating to the next possession. If any combination of the next four plays results in a gain of at least ten yards, winnings of three dollars can be awarded. If any combination of the next four plays results in points scored, winnings of four dollars can be awarded. If the next four plays do not result in a gain of ten yards or more, the primary bet can be lost.

It can also be contemplated that specific types of allowed primary bets, allowed primary bet amounts, and specific odds and payouts can be determined and customized by individual owners of the present system, such as a casino, an arcade, or other private owners.

The database can also include computer instructions for instructing the processor to permit input of one or more secondary bets from the input device and the monetary acceptance feature.

Secondary bets can include side bets, in addition to the primary bet. For example, a primary bet relating to the gain of yards on the upcoming play can be placed, while a secondary bet relating to the scoring of points on the upcoming play can be placed simultaneously. If the next play results in a gain of yards without scoring points, winnings relating to only the primary bet can be paid.

Secondary bets accepted by the processor can include bets relating to the winner of the game, bets specifying which team will have more points at a certain point in the game, or similar bets relating to the game outcome.

Secondary bets can also be placed relating to amounts of points scored by either or both simulated football teams, the spread in points between the two simulated teams, or other bets relating to point totals.

Secondary bets can also be placed relating to play achievements, including individual plays and/or game outcomes, such as whether the next card played will result in a successful run, a failed run, a successful pass, a failed pass, a first down, a successful field goal, a missed field goal, a successful touchdown, points scored, a loss of yards, a turnover, a safety, or any other possible game outcome.

Secondary bets can also include long term, "hard" bets, that persist until the completion of a possession, or until the completion of the game, such as a successful or failed third down conversion, a successful or failed fourth down conversion, a successful or missed field goal, a successful or failed touchdown, a safety, a turnover, a first down, or other similar bets.

It can be contemplated that specific types of allowed secondary bets, allowed secondary bet amounts, and specific odds and payouts can be determined and customized by individual facilities or owners of the present system.

Additional computer instructions can be used to instruct the processor to electronically deal a first plurality of cards from the electronic deck of playing cards and to display the first plurality of cards on the display. It can be contemplated that the first plurality of cards constitutes the user's hand. In an embodiment, a user's hand can include from five to eleven cards. The number of cards in a user's hand can be determined by the owner of the present system.

Computer instructions can also instruct the processor to electronically deal a second plurality of cards from the electronic deck of playing cards to a simulated player controlled by the processor. It can be contemplated that the second plurality of cards can include the same number of cards as the first plurality of cards.

Computer instructions can then instruct the processor to designate a football offense player and a football defense player. The designation can be performed randomly. In an embodiment, the computer instructions can permit selection by a user using the input device to indicate whether the user wishes to begin play as the football offense player or the football defense player.

In an embodiment, computer instructions in the database can be used to instruct the processor to permit selection of a coin toss outcome by a user, to simulate a coin toss and display the coin toss outcome, and to compare the coin toss outcome with the selected outcome, permitting designation of the football offense player and football defense player by the user if the coin toss outcome matches the selected outcome. It can be contemplated that a simulated coin toss can be used to determine the beginning football offense player and football defense player, to simulate the manner in which beginning offensive and defensive teams are designated in a professional football game.

The database can also include computer instructions for instructing the processor to permit selection of a first card by the football offense player and to display the first card on the display. Computer instructions can also instruct the processor to electronically deal to the football offense player a replacement card for the first card from the electronic deck of playing cards.

It can be contemplated that typically, the football offense player can select and play an offensive play card to attempt to gain a number of yards and/or score points.

In the event that the football offense player selects an offensive play card, computer instructions can be used to instruct the processor to permit the football defense player to select a second card and to display the second card. The second card can be selected for discard, or the second card can be a defensive play card having a type of play indicated thereon that corresponds to the type of play indicated on the offensive play card.

Even if the second card is discarded, it can be contemplated that computer instructions can instruct the processor to display the discarded card on the display, to facilitate counting of cards and tracking of possible future plays.

In the event that the football defense player selects a defensive play card having a type of play corresponding to the play indicated on the offensive play card, both the offensive play card and the defensive play card can be used to determine the game outcome.

Computer instructions can then instruct the processor to deal a replacement card for the second card.

It can also contemplated that the football offense player can perform a tactic known as "clutching," by playing a defensive play card rather than an offensive play card. The football offense player can voluntarily incur the negative consequences of the selected defensive play card, and computer instructions can then instruct the processor to deal a replacement card for the selected defensive play card. This strategy can be useful when a player wishes to intentionally lose one or more individual plays to cause a desirable long term game outcome, such as a resulting specified point total on which the player has placed a secondary bet. "Clutching" can also be useful when a football offense player lacks sufficient offensive play cards to score points but possesses special defensive play cards that can possibly cause a turnover or a safety when playing as the football defense player.

If the football offense player plays a defensive play card, it can contemplated that the football defense player is not permitted to select a second card for discard or to select a second card to play in response for the first card.

Computer instructions in the database can then instruct the processor to determine a game outcome based on the first card, and if played, the second card. Game outcomes can include a gain or loss of yards, scored points, accumulation of a down, achievement a new first down, a turnover, which causes the football defense player to be designated as the football offense player and the football offense player to be designated as the football defense player, or other similar results.

In an embodiment, computer instructions can instruct the processor to play a video, animation, or combinations thereof, that depicts a representation of the game outcome. For example, a video or animation of a quarterback completing a long pass prior to an unsuccessful quarterback sack can be played when the football offense and football defense players play cards indicating such a result.

The database can also include computer instructions for instructing the processor to award winnings based on the primary bet, the one or more secondary bets, and the game outcome.

In an embodiment, the database can include computer instructions for instructing the processor to permit selection of one or more cards by the football offense player to be placed in an offense time out hand, which can be stored in the database. The computer instructions can also permit selection of cards by the football defense player to form a defense time out hand, which can also be stored in the database.

Computer instructions in the database can then be used to instruct the processor to permit the football offense player or the football defense player to declare a time out during play, and to permit each player to select cards for exchange with selected cards from their respective time out hands. It can be contemplated that the computer instructions can instruct the processor to designate a limited number of times each player can declare a time out, such as twice per each half of the simulated game of football.

For example, a football defense player can select five offensive play cards for placement in a time out hand, while retaining sufficient defensive play cards to cause a turnover, which designates the football offense player as the football defense player and the football defense player as the football offense player. At that time, the football offense player, who was previously the football defense player, can declare a time out and exchange one or more cards with the time out hand to acquire the offensive play cards that were placed in the time out hand.

A simulated game of football can be divided into quarters, halves, or other segments of time, by automatically determining that each segment of time expires after a predetermined number of cards have been played. Users or owners of the present system can also be permitted to select the length of each half, or other time segment, of the simulated football game. For example, each time the electronic deck of playing cards can be exhausted, it can be declared that one half of the simulated game of football has expired. The present system can then electronically randomize the cards, electronically deal hands to each player, and begin the second half of play.

In an embodiment, computer instructions in the database can instruct the processor to permit the football offense player to elect to perform a special teams play in lieu of selecting the first card. The computer instructions can then instruct the processor to electronically deal a first special teams card from the electronic deck of special teams cards and to display the first special teams card on the display. The first special teams card can be used to determine the game outcome.

For example, if a simulated line of scrimmage is within thirty yards of a simulated defense team's goal line, a special teams card can be electronically dealt to represent an attempt to score a field goal. The special teams card can then indicate whether points are scored, or whether the simulated field goal attempt was missed. If the simulated line of scrimmage is farther than thirty yards from the simulated defense team's goal line, the special teams card can be electronically dealt to represent an attempt to punt.

Computer instructions in the database can also be used to instruct the processor to permit the football defense player to elect to perform a special teams response in response to the first special teams card. The computer instructions can instruct the processor to electronically deal a second special teams card from the electronic deck of special teams cards and display the second special teams card on the display. Computer instructions can then instruct the processor to determine the game outcome based on the first special teams card and the second special teams cards.

For example, a football offense player can elect to have a first special teams card electronically dealt to simulate a punt attempt. The first special teams card can display a number of yards or another result or instruction associated with a punt attempt. The football defense player can then elect to have a second special teams card electronically dealt to simulate a punt return, which can display a number of yards returned, or another result, such as a blocked punt or a fumble, in association with a punt return attempt.

The football defense player can also elect not to have a second special teams card electronically dealt in response to the first special teams card. For example, to simulate a fair catch, the football defense player can permit a simulated punt attempt to take place without attempting a simulated punt return.

It can be contemplated that the database can also include computer instructions for instructing the processor to display on the display device a simulated football field. The simulated football field can include a gridiron, twenty yard markers that designate five-yard intervals, a down indicator, a score indicator, a possession indicator, a quarter indicator, or combinations thereof.

Computer instructions can further instruct the processor to display on the simulated football field a simulated line of scrimmage, which can include depictions of simulated offensive and defensive football teams and a simulated game ball.

Computer instructions can also instruct the processor to update positions of the line of scrimmage, numbers of downs, a score, a possession, a quarter, or combinations thereof, based on the game outcome.

An embodiment can enable the simulated football game to be represented not only using cards and/or tabular means, but through graphical means as well.

It can be contemplated that computer instructions in the database can also instruct the processor to display on the display a yards rushing indicator, a yards passing indicator, a total offense indicator, a field goal made indicator, a field goal missed indicator, a kickoff return yardage indicator, a punt return yardage indicator, other similar indicators for displaying game information and statistics, or combinations thereof.

Computer instructions can further instruct the processor to update information and values indicated by any of the indicators. It can be contemplated that one or more secondary bets can be placed relating to information contained in any of the indicators. For example, a player can place a secondary bet relating to the total number of yards rushing obtained by one of the simulated football teams, or the total number of field goals made by one of the simulated teams.

A player can also place a secondary bet identifying a team that will have a greater value in one of the indicated statistics than that of the other team, such as betting that the player-controlled team will have a larger number of total yards rushed than the simulated player's team. This secondary bet feature thereby incentivizes a player to select cards strategically, attempting to fulfill conditions necessary to win a secondary bet, in addition to selecting cards to win the simulated game of football or to successfully accomplish plays.

In an embodiment, the present system can also include a secondary bonus slot game. Computer instructions in the database can instruct the processor to display the secondary bonus slot game if one or more play achievements occur. Play achievements can include scoring one or more points, achieving one or more offensive or defensive plays, advancing a predetermined number of yards, scoring a touchdown, scoring a field goal, advancing a predetermined number of yards with a single play, or any other possible game outcome.

The computer instructions can then instruct the processor to permit input of a bonus bet using the input device and the monetary acceptance feature.

The computer instructions can instruct the processor to electronically spin reels of the secondary bonus slot game and stop the reels, then award bonus winnings based on the bonus bet and the play achievements.

In an embodiment, the processor of the present system can be in communication with one or more networks, for enabling multiple football video card gaming systems to track and maintain a progressive jackpot. Progressive jackpots can be awarded to a player for one or more rare play achievements, such as winning a simulated game of football during a simulated overtime period. Progressive jackpots can also be tied to the secondary bonus slot game.

Referring now to FIG. 1, a schematic drawing of an embodiment of the present system is depicted.

FIG. 1 depicts a processor (10), which can be in communication with a first input device (12), a second input device (14), a third input device (16), a fourth input device (18), a fifth input device (20), a display device (22), and a database (28).

The display device (22) can be depicted as a screen, which is shown displaying five electronic playing cards simultaneously. Each input device (12, 14, 16, 18, 20) can be depicted as a button, which can be contemplated to be useable to select a corresponding card displayed on the display device (22).

While FIG. 1 depicts a single display device (22), it can be contemplated that the present system can include multiple display devices, such as separate display screens for each electronic playing card, a time out hand, videos and/or animations representing game outcomes, game statistics and/or bet information, a simulated football field with a simulated line of scrimmage, a secondary bonus slot game, electronic special teams cards, other game features, or combinations thereof.

While each input device (12, 14, 16, 18, 20) can be depicted as a button, it can be contemplated that input devices can also be keyboards, keypads, a touch screen, levers, switches, or other similar input devices.

FIG. 1 depicts the processor (10), which can further be in communication with a first monetary acceptance feature (24), which can be depicted as a reader for reading credit cards, debit cards, and/or facility-issued cards such as cards containing monetary units, and a second monetary acceptance feature (26), which can be depicted as a coin or token slot. Other monetary acceptance features, such as slots for accepting bills, or keypads for receiving input of credit and/or debit card information can also be contemplated.

The database (28) can be depicted containing an electronic deck of playing cards (36), which can contain offensive playing cards (30) and defensive playing cards (32). The database (28) can also include an electronic deck of special teams cards (34).

Computer instructions (38) in the database (28) can be useable to instruct the processor (10) to electronically randomize the electronic decks of cards. Electronically randomizing the cards can include simulating shuffling of the decks and storing the shuffled order of the cards in the database (28). Electronically randomizing the cards can also include randomly determining the identity of each card at the time it is dealt.

Computer instructions (40) in the database (28) can instruct the processor (10) to permit input of a primary bet using one or more of the input devices (12, 14, 16, 18, 20) and one or more of the monetary acceptance features (24, 26). It can be contemplated that the primary bet can be stored in the database (28) until the game outcome is determined and winnings can be awarded.

Computer instructions (42) in the database (28) can also instruct the processor (10) to permit input of a secondary bet using one or more of the input devices (12, 14, 16, 18, 20) and one or more of the monetary acceptance features (24, 26). It can be contemplated that the secondary bet can also be stored in the database (28) until the game outcome is determined and winnings can be awarded.

FIG. 1 further depicts computer instructions (44) in the database (28), which can instruct the processor (10) to electronically deal a first plurality of cards from the electronic deck of playing cards (36) and to display the first plurality of cards on the display device (22). The first plurality of cards can be contemplated to constitute a user's hand.

Computer instructions (46) in the database (28) can instruct the processor (10) to electronically deal a second plurality of cards from the electronic deck of playing cards (36) to a simulated player controlled by the processor (10). The second plurality of cards can be contemplated to constitute the simulated player's hand.

Computer instructions (48) in the database (28) can instruct the processor (10) to designate a football offense player and a football defense player. The designation of the football offense and defense players can be a random designation, or in an embodiment, a user can be permitted to designate the football offense and defense players.

It can also be contemplated that computer instructions (90) in the database (28) can instruct the processor (10) to permit a user to select a coin toss outcome using one or more of the input devices (12, 14, 16, 18, 20). Computer instructions (92) in the database (28) can then instruct the processor (10) to execute a simulated coin toss and obtain a coin toss outcome. Computer instructions (94) in the database (28) can then instruct the processor (10) to compare the coin toss outcome with the outcome selected by the user, and to permit designation of the football offense and defense players by the user if the selected outcome matches the coin toss outcome.

Computer instructions (50) in the database (28) can instruct the processor (10) to permit selection of a first card by the football offense player and to display the first card on the display device (22).

Computer instructions (52) in the database (28) can instruct the processor (10) to electronically deal a replacement card for the first card from the electronic deck of playing cards (36).

FIG. 1 also depicts computer instructions (54) in the database (28), which can instruct the processor (10) to determine a game outcome based on the first card. Computer instructions (56) in the database (28) can instruct the processor (10) to award winnings based on the primary and secondary bets and the game outcome.

If the first card is an offensive play card, computer instructions (58) in the database (28) can instruct the processor (10) to permit selection of a second card by the football defense player and to display the second card on the display device (22). The computer instructions (54) for determining the game outcome can then determine the game outcome based on both the first card and the second card. In addition to, or in lieu of displaying the second card on the display device (22), the computer instructions (54) can further instruct the processor to display a video and/or animation representing the game outcome.

Computer instructions (60) in the database (28) can instruct the processor (10) to electronically deal a replacement card for the second card.

FIG. 1 further depicts computer instructions (62) in the database (28), which can instruct the processor (10) to permit selection of one or more cards by the football offense player to form an offensive time out hand, and to store the offensive time out hand in the database (28).

Computer instructions (64) in the database (28) can instruct the processor (10) to permit selection of one or more cards by the football defense player to form a defensive time out hand, and to store the defensive time out hand in the database (28).

Computer instructions (66) in the database (29) can then be used to instruct the processor (10) to permit the football offense player or the football defense player to declare a time out prior to selecting a card for discard or play.

When a time out is declared, computer instructions (68) in the database (28) can instruct the processor (10) to permit selection of one or more cards by the football offense player for exchange with cards in the offensive time out hand. Computer instructions (70) in the database (28) can instruct the processor (10) to permit selection of one or more cards by the football defense player for exchange with cards in the defense time out hand.

FIG. 1 also depicts computer instructions (72) in the database (28), which can instruct the processor (10) to permit the football offense player to elect to have a special teams card electronically dealt from the electronic deck of special teams cards (34) in lieu of selecting a card for discard or play.

Computer instructions (74) in the database (28) then instruct the processor (10) to electronically deal a special teams card from the electronic deck of special teams cards (34) and to display the special teams card on the display (22). Computer instructions (54) can then instruct the processor (10) to determine the game outcome based on the special teams card.

Computer instructions (76) in the database (28) can instruct the processor (10) to permit the football defense player to elect to have a special teams card electronically dealt from the electronic deck of special teams cards (34), in response to the special teams card dealt to the football offense player. The computer instructions (74) can then instruct the processor (10) to electronically deal a special teams card to the football defense player. The computer instructions (54) for determining the game outcome can then instruct the processor (10) to determine the game outcome based on both special teams cards.

FIG. 1 also depicts computer instructions (78) in the database (28), which can instruct the processor (10) to permit input of team information using one or more of the input devices (12, 14, 16, 18, 20). The computer instructions (78) can further instruct the processor (10) to store the team information in the database (28), and to permit modification to the team information using the input devices (12, 14, 16, 18, 20).

Team information can be used to personalize a team and add or remove simulated players, which can be fictional football players or representations of existing professional football players from various time periods. Team information can also be used to name teams and/or identify players for tracking winnings, statistics, and/or high scores.

Computer instructions (80) in the database (28) can instruct the processor (10) to display a simulated football field on the display device (22). Computer instructions (82) in the database (28) can instruct the processor (10) to display a simulated line of scrimmage on the simulated football field. Computer instructions (84) in the database (28) can then instruct the processor (10) to update information on the display device (22), such as positions of the simulated line of scrimmage, numbers of downs, points scored, possessions, quarters, other similar information, or combinations thereof.

FIG. 1 also depicts computer instructions (86) in the database (28), which can instruct the processor (10) to display on the display device (22) one or more indicators for providing game information and statistics. Indicators can include a yards rushing indicator, a yards passing indicator, a total offense indicator, a field goals made indicator, a field goals missed indicator, a kickoff return yardage indicator, a punt return yardage indicator, other similar indicators for displaying game information and statistics, or combinations thereof.

Computer instructions (88) in the database (28) can instruct the processor (10) to update the displayed indicators based on the game outcome.

FIG. 1 also shows computer instructions (96) in the database (28), which can instruct the processor (10) to permit the football offense player and/or the football defense player to select a card for discard. Computer instructions (98) in the database (28) can instruct the processor (10) to electronically deal a replacement card for the discarded card from the electronic deck of playing cards (36).

FIG. 1 further depicts computer instructions (100) in the database (28) for instructing the processor (10) to display a secondary bonus slot game if one or more play achievements occur. For example, the secondary bonus game can be engaged each time a touchdown is scored, each time a new first down is achieved, each time a punt is kicked, each time a field goal is scored, each time a quarterback is sacked, each time a long pass is completed, or any other possible game outcome.

Computer instructions (102) in the database (28) can instruct the processor (10) to permit input of a bonus bet from one or more of the input devices (12, 14, 16, 18, 20) and monetary acceptance features (24, 26).

Computer instructions (104) in the database (28) can also instruct the processor (10) to electronically spin and stop reels of the secondary bonus slot game, or otherwise generate a graphical outcome of the secondary bonus slot game.

Computer instructions (106) in the database (28) can then instruct the processor (10) to award bonus winnings based on the bonus bet and one or more play achievements.

Figure 2:
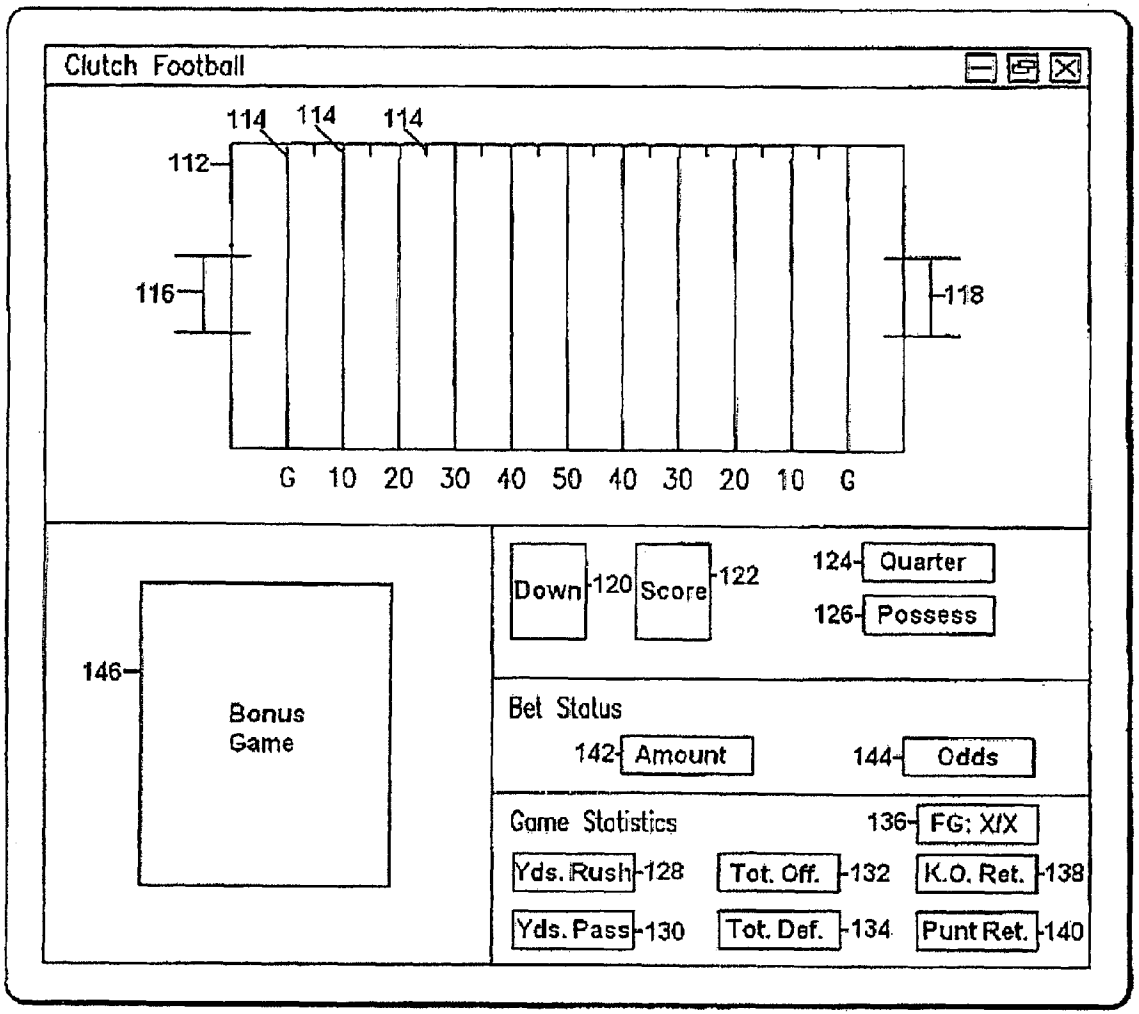
FIG. 2 depicts a display of an embodiment of a simulated football field displayed by the present system.

FIG. 2 depicts an embodiment of a simulated football field (112) which can be displayed on one or multiple display devices. The simulated football field (112) is shown having a plurality of yard markers (114), each designating a five-yard interval, a first football goal (116), and a second football goal (118).

FIG. 2 also depicts a down indicator (120) and a score indicator (122), for displaying numbers of downs and points scored, as determined by the game outcome.

FIG. 2 further depicts a quarter indicator (124), for indicating the current quarter of the simulated game of football. The quarter indicator (124) can also indicate halves, or other segments of simulated time. FIG. 2 additionally depicts a possession indicator (126), for indicating the player which is currently the football offense player.

FIG. 2 also depicts numerous indicators for game statistics, including a yards rushing indicator (128), a yards passing indicator (130), a total offense indicator (132), and a total defense indicator (134). A field goal indicator (136) is also depicted, which can indicate both a number of field goals made and a number of field goals missed, or a percentage, fraction, or decimal representing the portion of field goals made. The field goal indicator (136) can also include two separate indicators, a first indicating a number of field goals made and a second indicating a number of field goals missed.

A kickoff return yardage indicator (138) and a punt return yardage indicator (140) are also depicted.

FIG. 2 further depicts indicators for bets, which can include a bet amount indicator (142), and an odds indicator (144). Other indicators relating to primary and/or secondary bets made relating to the game outcome can also be displayed, such as an indicator for a total amount won or lost, minimum and/or maximum bet indicators, and similar indicators.

FIG. 2 also depicts an area for displaying a secondary bonus slot game (146). The area for displaying the secondary bonus slot game (146) can include indicators displaying bets made, odds, minimum and/or maximum bets, information relating to game outcomes, and other similar indicators and information.

While these embodiments have been described with emphasis on the embodiments, it should be understood that within the scope of the appended claims, the embodiments might be practiced other than as specifically described herein.

What is claimed is:

1. A video card gaming system for simulating a football game, the system comprising:

a. a processor;

b. at least one input device in communication with the processor;

c. at least one display device in communication with the processor;

d. at least one monetary acceptance feature in communication with the processor; and e. a database in communication with the processor, the database comprising:

i. an electronic deck of playing cards comprising offensive play cards and defensive play cards;

ii. an electronic deck of special teams cards;

iii. computer instructions for instructing the processor to permit input of a primary bet from the at least one input device and the at least one monetary acceptance feature;

iv. computer instructions for instructing the processor to permit input of at least one secondary bet from the at least one input device and the at least one monetary acceptance feature;

v. computer instructions for instructing the processor to electronically deal a first plurality of cards from the electronic deck of playing cards and display the first plurality of cards on the at least one display device;

vi. computer instructions for instructing the processor to electronically deal a second plurality of cards from the electronic deck of playing cards to a simulated player controlled by the processor;

vii. computer instructions for instructing the processor to designate a football offense player and a football defense player;

viii. computer instructions for instructing the processor to permit selection of a first card by the football offense player and display the first card on the at least one display device;

ix. computer instructions for instructing the processor to electronically deal to the football offense player a replacement card for the first card from the electronic deck of playing cards;

x. computer instructions for instructing the processor to determine a game outcome based on the first card; and xi. computer instructions for awarding winnings based on the primary bet, the at least one secondary bet, and the game outcome.

2. The system of claim 1, wherein the first card is an offensive play card, wherein the database further comprises:

a. computer instructions for instructing the processor to permit selection of a second card by the football defense player for discard or in response to the offensive play card;

b. computer instructions for instructing the processor to electronically deal to the football defense player a replacement card for the second card from the electronic deck of playing cards; and c. wherein the computer instructions for instructing the processor to determine the game outcome based on the first card and the second card.

3. The system of claim 1, wherein the database further comprises:

a. computer instructions for instructing the processor to permit selection of at least one card by the football offense player to form an offense time out hand and to store the offense time out hand in the database;

b. computer instructions for instructing the processor to permit selection of at least one card by the football defense player to form a defense time out hand and to store the defense time out hand in the database;

c. computer instructions for instructing the processor to permit the football offense player or the football defense player to declare a time out;

d. computer instructions for instructing the processor to permit the football offense player to select cards for exchange with the offense time out hand; and e. computer instructions for instructing the processor to permit the football defense player to select cards for exchange with the defense time out hand.

4. The system of claim 1, wherein the database further comprises:

a. computer instructions for instructing the processor to permit the football offense player to elect to perform a special teams play in lieu of selecting the first card;

b. computer instructions for instructing the processor to electronically deal a first special teams card from the electronic deck of special teams cards and display the first special teams card on the at least one display device; and c. wherein the computer instructions for instructing the processor to determine the game outcome based on the first special teams card.

5. The system of claim 1, wherein the database further comprises:

a. computer instructions for instructing the processor to permit the football defense player to elect to perform a special teams response in response to the first special teams card;

b. computer instructions for instructing the processor to electronically deal a second special teams card from the electronic deck of special teams cards and display the second special teams card on the at least one display device; and c. wherein the computer instructions for instructing the processor to determine the game outcome based on the first special teams card and the second special teams card.

6. The system of claim 1, wherein the database further comprises:

a. computer instructions for instructing the processor to permit input of team information from the at least one input device;

b. computer instructions for instructing the processor to store the team information in the database; and c. computer instructions for instructing the processor to permit modification of the team information using the at least one input device.

7. The system of claim 1, wherein the database further comprises:

a. computer instructions for instructing the processor to display on the at least one display device a simulated football field comprising a gridiron, twenty yard markers that designate five-yard intervals, a down indicator, a score indicator, a possession indicator, a quarter indicator, or combinations thereof;

b. computer instructions for instructing the processor to display on the at least one display device a simulated line of scrimmage on the simulated football field; and c. computer instructions for instructing the processor to update on the at least one display device a position of the simulated line of scrimmage, a number of downs, a score, a possession, a quarter, or combinations thereof, based on the game outcome.

8. The system of claim 1, wherein the database further comprises:

a. computer instructions for instructing the processor to display on the at least one display device a yards rushing indicator, a yards passing indicator, a total offense indicator, a total defense indicator, a field goals made indicator, a field goals missed indicator, a kickoff return yardage indicator, a punt return yardage indicator, or combinations thereof; and b. computer instructions for instructing the processor to update on the at least one display device a number of yards rushed, a number of yards passed, the total offense indicator, the total defense indicator, a number of field goals made, a number of field goals missed, the kickoff return yardage indicator, the punt return yardage indicator, or combinations thereof, based on the game outcome.

9. The system of claim 1, wherein the computer instructions for instructing the processor to designate the football offense player and the football defense player comprise:

a. computer instructions for instructing the processor to permit selection of a coin toss outcome from the at least one input device, forming a selected coin toss outcome;

b. computer instructions for instructing the processor to execute a simulated coin toss and display the coin toss outcome on the at least one display device; and c. computer instructions for instructing the processor to compare the coin toss outcome with the selected coin toss outcome and to permit designation of the football offense player and the football defense player from the at least one input device if the coin toss outcome matches the selected coin toss outcome.

10. The system of claim 1, wherein the database further comprises:

a. computer instructions for instructing the processor to permit selection by the offense player of at least one offense card for discard, to permit selection by the defense player of at least one defense card for discard, or combinations thereof; and b. computer instructions for instructing the processor to electronically deal a replacement card from the electronic deck of playing cards to replace the at least one offense card for discard, the at least one defense card for discard, or combinations thereof.

11. The system of claim 1, wherein the at least one monetary acceptance feature is a means for accepting credit cards, a means for accepting debit cards, a means for accepting currency, a means for accepting facility-specific credits, or combinations thereof.

12. The system of claim 1, wherein the database further comprises:

a. computer instructions for instructing the processor to display on the at least one display device a secondary bonus slot game if at least one play achievement occurs;

b. computer instructions for instructing the processor to permit input of a bonus bet from the at least one input device and the at least one monetary acceptance feature;

c. computer instructions for instructing the processor to electronically spin reels of the secondary bonus slot game and stop the reels; and d. computer instructions for instructing the processor to award bonus winnings based on the bonus bet and the at least one play achievement.

13. The system of claim 1, further comprising at least one network in communication with the processor for storing a progressive jackpot.

14. The system of claim 1, wherein the at least one input device comprises at least one button, at least one lever, a touch screen, a keypad, or combinations thereof.

15. The system of claim 1, wherein the at least one secondary bet comprises a game winner bet, a point spread bet, a play achievement bet, or combinations thereof.

* * * * *